US005362002A

United States Patent [19]

Tsai

[11] Patent Number: 5,362,002

[45] Date of Patent: Nov. 8, 1994

[54] PAPER SHREDDER WITH AUTOMATIC PAPER FEEDING DEVICE

[76] Inventor: Shao-Nong Tsai, 4F, No.208, Sec.1, Wen-Hua Rd., Yung-Ho City, Taiwan, Prov. of China

[21] Appl. No.: 179,062

[22] Filed: Jan. 10, 1994

[51] Int. Cl.[5] ..... B02C 1/08; B02C 23/02

[52] U.S. Cl. ..... 241/222; 241/236

[58] Field of Search ..... 241/222, 225, 235, 236, 241/242, 243; 271/256, 262, 225

[56] References Cited

U.S. PATENT DOCUMENTS

| | | | |
|---|---|---|---|
| 4,815,669 | 3/1989 | Fujii | 241/236 X |
| 4,846,413 | 7/1989 | Inoue | 241/236 |
| 4,913,360 | 4/1990 | Lane et al. | 241/236 X |
| 4,964,579 | 10/1990 | Strohmeyer | 241/236 X |
| 5,188,301 | 2/1993 | Hasegawa | 241/236 X |

*Primary Examiner*—Timothy V. Eley
*Attorney, Agent, or Firm*—Beveridge, DeGrandi Weilacher & Young

[57] ABSTRACT

A paper shredder includes a box-like casing, a shredding roller assembly provided in the casing, and an automatic paper feeding device. The shredding roller assembly includes a pair of rotatable shredding rollers and a motor driving unit connected to the shredding rollers. The feeding device includes a tray which is mounted to the casing adjacent to the shredding roller assembly, a rotary shaft which is mounted rotatably on the tray, a tension spring which is connected to the rotary shaft and the tray, and at least one push rod, each of which having two pivotally connected rod sections. A first one of the rod sections is mounted on the rotary shaft, while a second one of the rod sections is provided with a press piece which presses against a stack of paper sheets on the tray. The feeding device further includes a pinion which is mounted securely on one end of the rotary shaft, and a wheel which has a sector portion formed with gear teeth and which is driven rotatably by the motor driving unit so as to drive rotatably and intermittently the pinion to rotate correspondingly the rotary shaft against action of the tension spring to cause movement of the press piece and some of the paper sheets toward the shredding roller assembly.

7 Claims, 3 Drawing Sheets

PAPER SHREDDER WITH AUTOMATIC PAPER FEEDING DEVICE

BACKGROUND OF THE INVENTION

1. Field of the Invention

The invention relates to a paper shredder, more particularly to a paper shredder with an automatic paper feeding device.

2. Description of the Related Art

Paper shredders are employed to destroy secret documents before disposing of the same. In conventional paper shredders, loose paper sheets are fed manually to shredding rollers in order to cut the same into pieces. Note that a relatively large amount of manpower is required if stacks of paper documents are to be destroyed. Furthermore, the number of paper sheets which are fed to the shredding rollers has to be controlled in order to prevent jamming of the latter.

SUMMARY OF THE INVENTION

The objective of the present invention is to provide a paper shredder with an automatic paper feeding device which can obviate the need for manually feeding paper sheets to the shredding rollers and which can control the number of paper sheets which are fed to the shredding rollers in order to prevent jamming of the latter.

Accordingly, the paper shredder of the present invention includes a box-like casing, a shredding roller assembly provided in the casing, and an automatic paper feeding device. The shredding roller assembly includes a pair of rotatable shredding rollers and a motor driving unit connected to and driving rotatably the shredding rollers. The automatic paper feeding device comprises:

- a tray adapted to receive a stack of paper sheets thereon and having a bottom wall with a front end, a rear end and two sides, the tray further having side walls extending respectively from the two sides of the bottom wall and a rear wall extending from the rear end of the bottom wall, the tray being mounted to the casing such that the front end of the bottom wall is disposed adjacent to the shredding roller assembly;
- a rotary shaft mounted rotatably to and extending between the side walls;
- at least one push rod, each of which including a first rod section with a first end mounted on the rotary shaft and a second end, and a second rod section with a first end connected pivotally to the second end of the first rod section and a second end provided with a press piece which is adapted to press against the stack of paper sheets on the tray;
- a tension spring having a first end connected to the rotary shaft and a second end connected to the tray; and
- a gear set including a pinion mounted securely on one end of the rotary shaft, and a wheel mounted rotatably on one of the side walls and having a sector portion formed with gear teeth, the wheel being connected to and driven rotatably by the motor driving unit so as to drive rotatably and intermittently the pinion to rotate correspondingly the rotary shaft against action of the tension spring to cause movement of the press piece and some of the paper sheets toward the shredding roller assembly.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
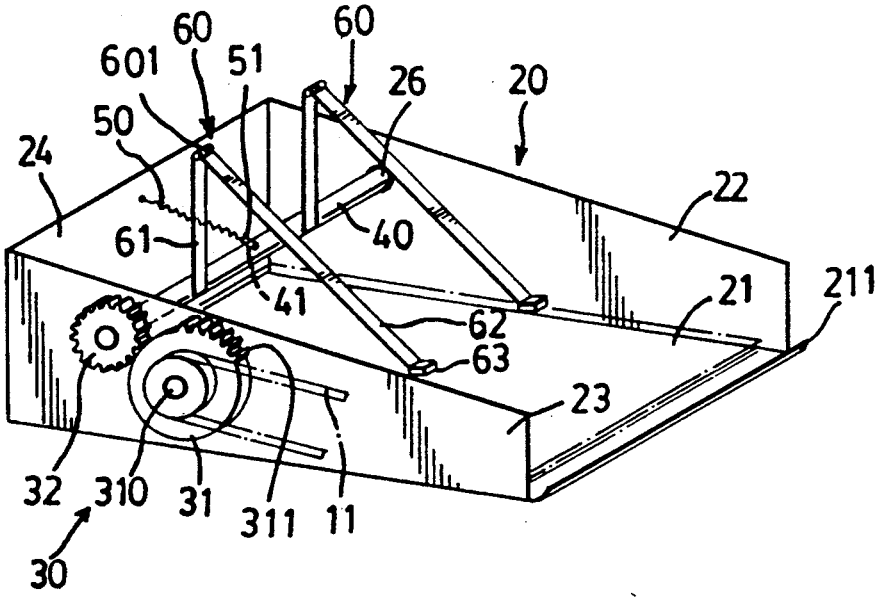
FIG. 1 is a perspective view of an automatic paper feeding device of the paper shredder of the present invention.

Before the present invention is described in greater detail, it should be noted that like elements are indicated by the same reference numerals throughout the disclosure.

Referring to FIG. 1, the automatic paper feeding device of the paper shredder of the present invention is shown to comprise a rectangular paper receiving tray 20, a gear set 30, a rotary shaft 40, a tension spring 50, and a pair of push rods 60.

The tray 20 has a bottom wall 21, side walls 22, 23 which extend upwardly and respectively from two sides of the bottom wall 21, and a rear wall 24 which extends upwardly from a rear end of the bottom wall 21. The bottom wall 21 has a distal front end which is formed with an upwardly inclining flange 211. The side walls 22, 23 are formed with aligned shaft holes 26 adjacent to the rear wall 24.

The rotary shaft 40 is an elongated cylindrical shaft which extends between the side walls 22, 23. The rotary shaft 40 has two ends which extend into the shaft hole 26 in the respective one of the side walls 22, 23. The rotary shaft 40 further has an intermediate portion which is formed with a pin hole 41.

The gear set 30 includes a unidirectional belt wheel 310 mounted rotatably on an outer wall surface of the side wall 23, and a wheel 31 mounted securely and coaxially on an outer periphery of the belt wheel 310. The wheel 31 has a sector portion formed with gear teeth 311. The gear set 30 further includes a pinion 32 mounted securely on one end of the rotary shaft 40 on the outer wall surface of the side wall 23. When the belt wheel 310 is driven to rotate in a predetermined direction, the wheel 31 rotates therewith and engages intermittently the pinion 32, thereby resulting in intermittent rotation of the rotary shaft 40.

The tension spring 50 has a first end connected to the rear wall 24 and a second end connected to a pin 51. The pin 51 is inserted fittingly in the pin hole 41 of the rotary shaft 40. The tension spring 50 is extended when the wheel 31 drives rotatably the pinion 32. When the wheel 31 ceases to engage the pinion 32, the tension spring 50 provides the necessary return force for rotating the rotary shaft 40 in an opposite direction so as to return the same to an initial position.

Each of the push rods 60 includes first and second rod sections 61, 62. The first rod section 61 has a first end mounted on the rotary shaft 40 by means of welding or with the use of a screw fastener (not shown). The rotary shaft 40 may be hexagonal in cross-section to facilitate mounting of the first rod section 61 on the rotary shaft 40 if a screw fastener is to be employed. The first rod section 61 further has a second end which is provided with a pivot joint 601 for connecting pivotally with a first end of the second rod section 62. The second rod section 62 has a second end which is provided with a rubber press piece 63 with a high friction coefficient. Since the press piece 63 has weight, the press piece 63 can be pressed tightly against a stack of paper sheets that is disposed on the tray 20.

Figure 2:
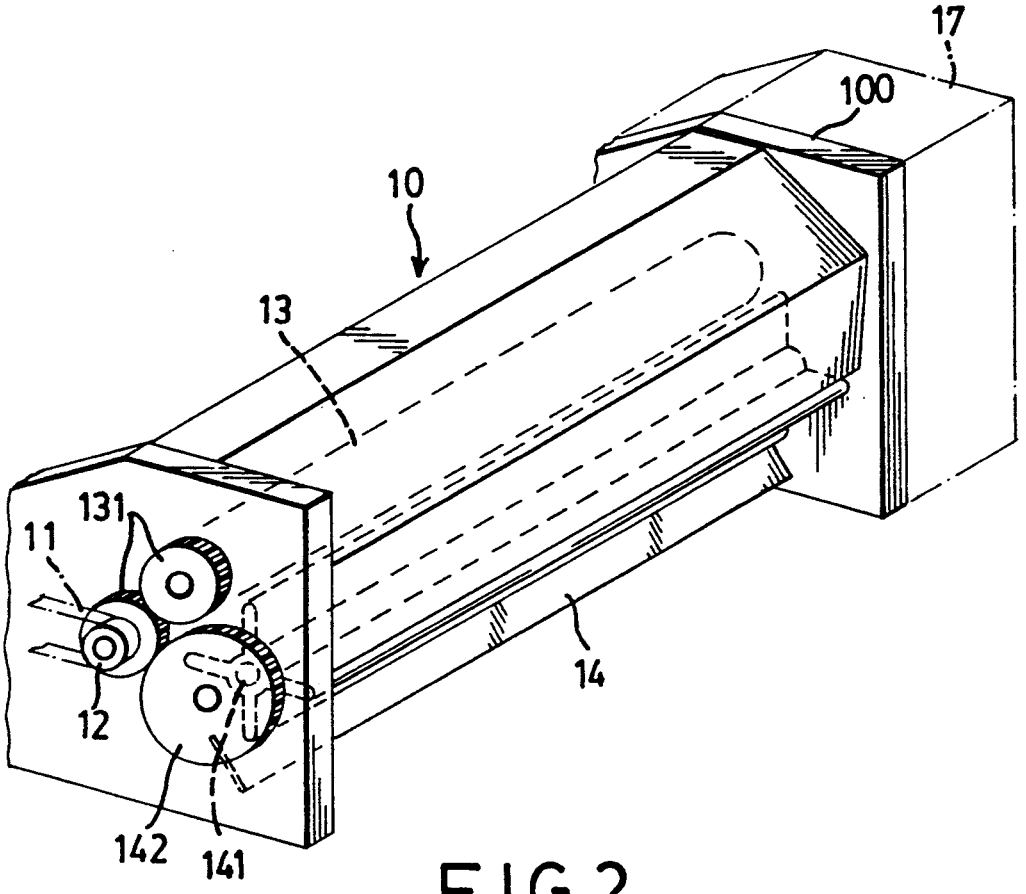
FIG. 2 is a perspective view of a shredding roller assembly of the paper shredder of the present invention.

FIG. 2 illustrates a shredding roller assembly 10 of the paper shredder of the present invention. The shredding roller assembly 10 includes a mounting frame 100, a pair of shredding rollers 13 mounted rotatably on the mounting frame 100, and a motor driving unit 17 mounted on the mounting frame 100 and connected to and driving rotatably the shredding rollers 13 in a conventional manner. The shredding rollers 13 are provided with gears 131 that mesh with one another. One of the gears 131 has a belt wheel 12 provided thereon. Referring to FIGS. 1 and 2, an endless belt 11 is trained between the belt wheels 12, 310. The belt wheels 12, 310 and the endless belt 11 constitute an endless transmission unit which transmits the rotation of the shredding rollers 13 to the wheel 31.

Figure 3:
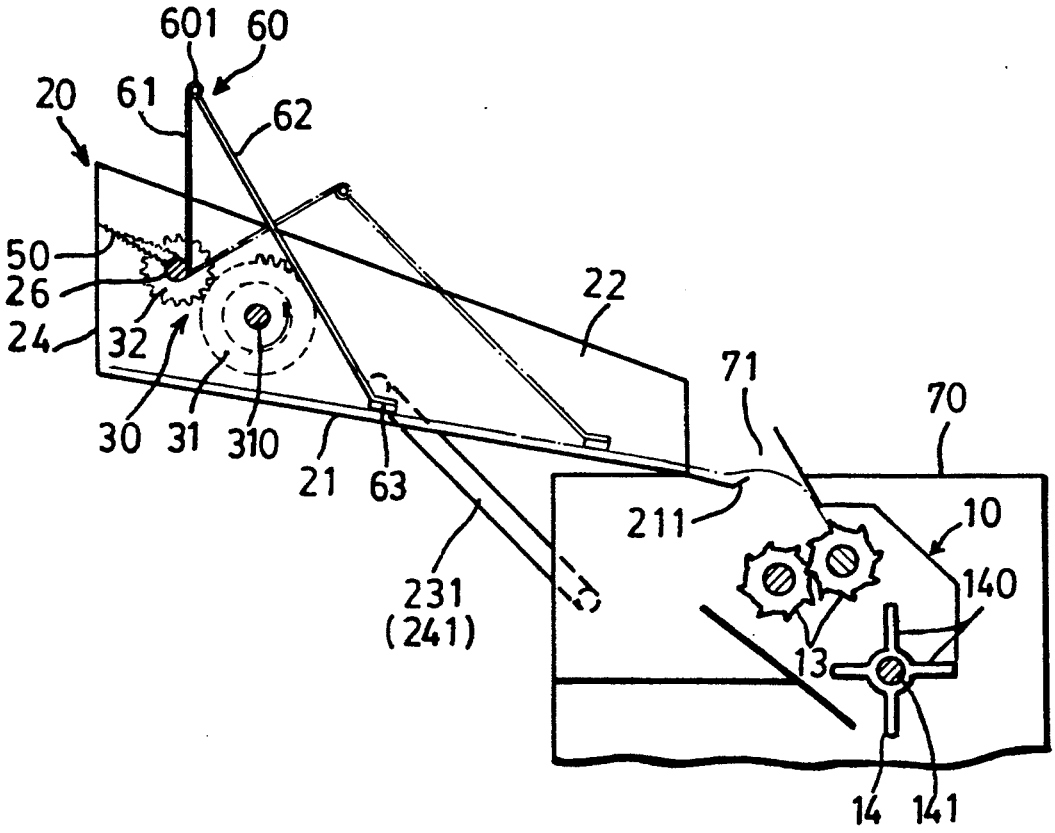
FIG. 3 illustrates the first preferred embodiment of a paper shredder with an automatic paper feeding device according to the present invention.

FIG. 3 illustrates the first preferred embodiment of a paper shredder according to the present invention. The paper shredder further comprises a box-like casing 70. The shredding roller assembly 10 is provided inside the casing 70 adjacent to a top end of the latter. The top end of the casing 70 is formed with a paper feed opening 71 to access the shredding roller assembly 10. In this embodiment, the tray 20 is mounted on the casing 70 by means of left and right support rods 231, 241. Each of the support rods 231, 241 has a first end secured threadedly to one of the side walls 22, 23 of the tray 20 and a second end secured threadedly to one of the side walls of the casing 70. The tray 20 is supported on the casing 70 in such a manner that the bottom wall 21 of the former inclines downwardly toward the shredding roller assembly 10. The distal front end of the bottom wall 21 of the tray 20 is adjacent to the feed opening 71 such that the flange 211 preferably extends into the same. Since the tray 20 is mounted inclinedly, paper sheets on the tray 20 can easily fall into the feed opening 71. The flange 211 serves to prevent this from happening.

When the belt wheel 310 is driven to rotate in a counterclockwise direction, the wheel 31 rotates therewith to enable the gear teeth 311 to engage the pinion 32. The rotary shaft 40 rotates in a clockwise direction against biasing action of the tension spring 50. The first rod section 61 of each push rod 60 rotates with the rotary shaft 40. Since the press pieces 63 are movable with respect to the bottom wall 21 of the tray 20, the second rod sections 62 pivot in a direction away from the corresponding first rod section 61 when the rotary shaft 40 rotates in a clockwise direction. As the press pieces 63 move toward the shredding roller assembly 10, some of the paper sheets on the tray 20 move therewith so as to be fed into the feed opening 71. When the gear teeth 311 on the wheel 31 ceases to engage the pinion 32, the tension spring 50 contracts so as to cause the rotation of the rotary shaft 40 in the clockwise direction to return the first and second rod sections 61, 62 of the push rods 60 to the previous position in preparation for another paper feeding operation. In this embodiment, the number of gear teeth 311 on the wheel 31 is selected so as to ensure that the shredding rollers 13 have initiated shredding of the paper sheets fed thereto before the tension spring 50 can pull the rotary shaft 40 to return the push rods 60 to the previous position. This is necessary to ensure that the paper sheets which are moved by the press pieces 63 to the feed opening 71 are not returned to the tray 20. This illustrates how the present invention accomplishes an automatic paper feeding operation.

The flange 211 preferably forms an angle greater than 90° with respect to the bottom wall 21 in order to prevent all of the paper sheets on the tray 20 from falling into the feed opening 71 at one time while permitting the movement of a small number of paper sheets past the same due to movement of the push rods 60.

Referring once more to FIGS. 2 and 3, the shredding roller assembly 10 further comprises an impelling roller 14 mounted rotatably on the mounting frame 100 and disposed below and adjacent to the shredding rollers 13. The impelling roller 14 is provided with a plurality of angularly spaced and radially extending blades 140. In this embodiment, the impelling roller 14 has four radially extending blades 140. The impelling roller 14 has one end 141 which is connected to the motor driving unit 17 by means of a driven gear 142 that meshes with one of the gears 131 of the shredding rollers 13. The diameter of the driven gear 142 is preferably larger than the diameter of the gears 131 in order to ensure that the driven gear 142 rotates at a speed which is slower than that of the gears 131. The impelling roller 14 serves to remove pieces of paper trapped between the shredding rollers 13 when the latter perform a paper shredding operation.

Although two push rods 60 were employed in this embodiment, the same result may be achieved when only one push rod 60 is installed. The presence of two push rods 60, however, ensures a more stable paper feeding movement. In addition, it is possible to provide the wheel 31 with more than one teethed sector portion in order to speed up the paper feeding operation. Alternatively, the diameters of the belt wheels 12, 310 may be varied in order to make the paper feeding operation faster.

Figure 4:
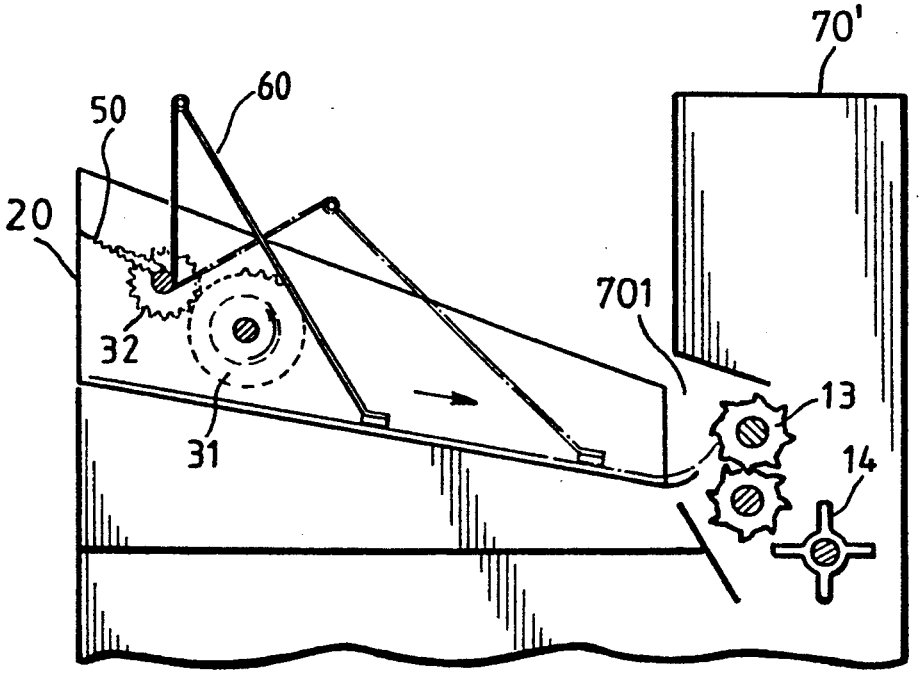
FIG. 4 illustrates the second preferred embodiment of a paper shredder with an automatic paper feeding device according to the present invention.

FIG. 4 illustrates the second preferred embodiment of a paper shredder according to the present invention. Unlike the previous embodiment, the tray 20 is an integral part of the box-like casing 70'. The feed opening 701 is formed on a side wall of the casing 70' and is directly in front of the tray 20.

Figure 5:
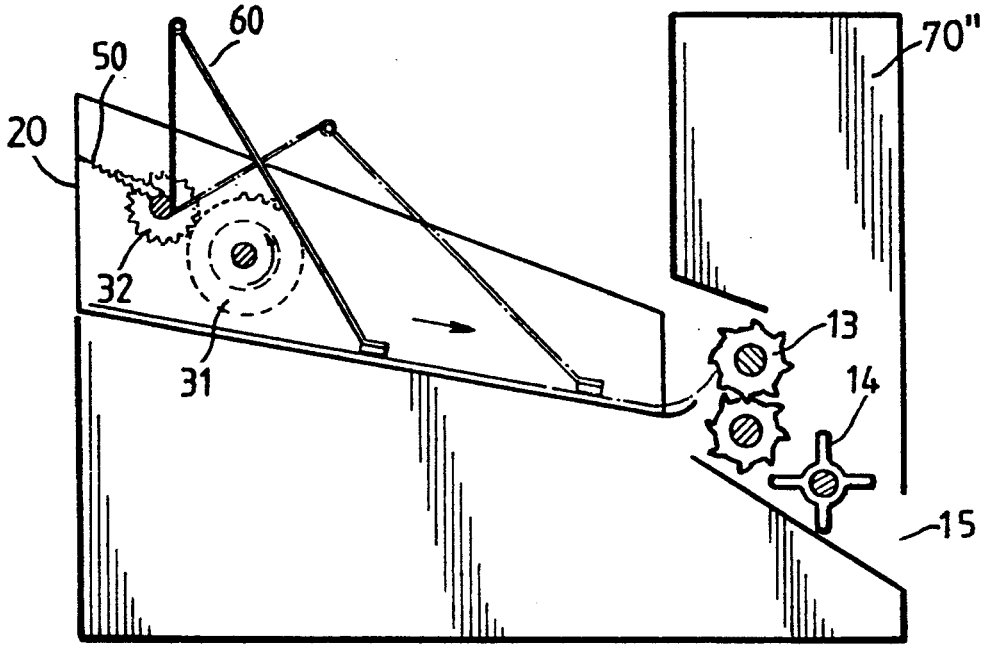
FIG. 5 illustrates the third preferred embodiment of a paper shredder with an automatic paper feeding device according to the present invention.

FIG. 5 illustrates the third preferred embodiment of a paper shredder according to the present invention. The third preferred embodiment is generally similar to the second preferred embodiment in construction. However, the box-like casing 70'' of the third embodiment has a back portion which is formed with an exit slot 15 for shredded paper. Thus, aside from removing pieces of paper trapped between the shredded rollers 13, the impelling roller 14 also serves to propel shredded paper to the exit slot 15 and further serves to conceal the shredded rollers 13 so as to prevent access to the latter, thereby making the third preferred embodiment safe to use.

It has thus been shown that the paper shredder of the present invention obviates the need for manually feeding paper sheets to the shredding rollers and can control the number of paper sheets which are fed to the shredding rollers to prevent jamming of the same. The objective of the present invention is thus achieved.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A paper shredder including a casing and a shredding roller assembly provided in said casing, said shredding roller assembly including a pair of rotatable shredding rollers and a motor driving unit connected to and driving rotatably said shredding rollers, wherein the improvement comprises:

an automatic paper feeding device including: a tray adapted to receive a stack of paper sheets thereon and having a bottom wall with a front end, a rear end and two sides, said tray further having side walls extending respectively from said two sides of said bottom wall and a rear wall extending from said rear end of said bottom wall, said tray being mounted to said casing such that said front end of said bottom wall is disposed adjacent to said shredding roller assembly; a rotary shaft mounted rotatably to and extending between said side walls; at least one push rod, each of which including a first rod section with a first end mounted on said rotary shaft and a second end, and a second rod section with a first end connected pivotally to said second end of said first rod section and a second end provided with a press piece which is adapted to press against the stack of paper sheets on said tray; a tension spring having a first end connected to said rotary shaft and a second end connected to said tray; and a gear set including a pinion mounted securely on one end of said rotary shaft, and a wheel mounted rotatably on one of said side walls and having a sector portion formed with gear teeth, said wheel being connected to and driven rotatably by said motor driving unit so as to drive rotatably and intermittently said pinion to rotate correspondingly said rotary shaft against action of said tension spring to cause movement of said press piece and some of the paper sheets toward said shredding roller assembly.

2. The paper shredder as claimed in claim 1, wherein said press piece is made of rubber and has a high friction coefficient.

3. The paper shredder as claimed in claim 1, wherein said bottom wall of said tray inclines downwardly toward said shredding roller assembly.

4. The paper shredder as claimed in claim 3, wherein said front end of said bottom wall of said tray is formed with an upwardly inclining flange which forms an angle that is greater than 90° with respect to said bottom wall.

5. The paper shredder as claimed in claim 1, wherein said shredding roller assembly further comprises a rotatable impelling roller which is disposed below and adjacent to said shredding rollers and which is provided with a plurality of angular spaced and radially extending blades, said impelling roller being connected to and driven rotatably by said motor driving unit to enable said impelling roller to remove pieces of paper trapped between said shredding rollers.

6. The paper shredder as claimed in claim 5, wherein said casing has a back portion formed with an exit slot, said impelling roller propelling shredded paper from said shredding rollers to said exit slot.

7. The paper shredder as claimed in claim 1, wherein said wheel is a unidirectional wheel.

* * * * *